US007024840B2

(12) United States Patent
Wilson, Jr. et al.

(10) Patent No.: US 7,024,840 B2
(45) Date of Patent: Apr. 11, 2006

(54) BAGGING APPARATUS FOR USE WITH WICKETED BAGS

(75) Inventors: Ollie B. Wilson, Jr., Newnan, GA (US); Robert F. Polkinghorne, Jonesboro, GA (US); Charles C. Tucker, Jr., McDonough, GA (US)

(73) Assignee: Starflex Corp., Jonesboro, GA (US)

( * ) Notice: Subject to any disclaimer, the term of this patent is extended or adjusted under 35 U.S.C. 154(b) by 0 days.

(21) Appl. No.: 10/697,778

(22) Filed: Oct. 30, 2003

(65) Prior Publication Data

US 2004/0088953 A1 May 13, 2004

Related U.S. Application Data

(60) Provisional application No. 60/422,661, filed on Oct. 31, 2002.

(51) Int. Cl.
*B65B 43/44* (2006.01)

(52) U.S. Cl. ..... 53/572; 53/284.7

(58) Field of Classification Search ..... 53/384.1, 53/385.1, 373.4, 284.7, 253, 260, 570, 571, 53/572, 457, 459, 468, 469, 474, 492
See application file for complete search history.

(56) References Cited

U.S. PATENT DOCUMENTS

| | | | | | |
|---|---|---|---|---|---|
| 3,495,378 | A * | 2/1970 | Kipers | 53/571 |
| 3,807,122 | A * | 4/1974 | Kihnke et al. | 53/459 |
| 3,979,879 | A * | 9/1976 | Rademacher | 53/572 |
| 4,172,349 | A * | 10/1979 | Lipes | 53/572 |
| 4,989,391 | A | 2/1991 | Wetter | |
| 5,177,939 | A * | 1/1993 | Lipes | 53/572 |
| 5,249,409 | A * | 10/1993 | Jensen | 53/469 |
| 5,421,143 | A * | 6/1995 | Savigny | 53/572 |
| 5,435,114 | A | 7/1995 | Moehlenbrock et al. | |
| 5,442,898 | A | 8/1995 | Gabree et al. | |
| 5,452,559 | A * | 9/1995 | Lipes | 53/572 |
| 5,467,578 | A | 11/1995 | Jensen | |
| 5,802,817 | A * | 9/1998 | Hood | 53/459 |
| 6,550,226 | B1 * | 4/2003 | Gates et al. | 53/459 |
| 6,662,532 | B1 * | 12/2003 | Droog et al. | 53/459 |

* cited by examiner

*Primary Examiner*—Louis Huynh
(74) *Attorney, Agent, or Firm*—Kenneth S. Watkins, Jr.

(57) ABSTRACT

A vertical bagging apparatus [101] comprises a bag station [105] having multiple stations [403A, 403B, 403C, 403D] for holding a variety of wicket-supported bags. A tooling assembly [107] accepts product for a product line and dispenses the product into an opened bag from the bag station. A bag transfer assembly [109] lowers the filled bag to a bag seal assembly [111] located vertically below the tooling assembly. The apparatus allows high speeds and quick-change of bags and bagged product.

10 Claims, 13 Drawing Sheets

BAGGING APPARATUS FOR USE WITH WICKETED BAGS

This Application claims priority benefits of U.S. Provisional Application No. 60/422,661, filed Oct. 31, 2002.

FIELD OF THE INVENTION

The present invention relates to bagging machines and, more particularly, to bagging machines utilizing pre-made wicket bags.

BACKGROUND OF THE INVENTION

Customer demand for more and better packaging has created a demand for methods and apparatus that provide new and more efficient ways to bag products. For example, poultry product suppliers face a growing demand for packaging a number of different poultry products of varying shapes, weights and sizes that requiring specialized marking and product identification. Unfortunately, bagging is a time-intensive and therefore costly evolution, and automated bagging equipment is expensive and often requires high levels of operator training and maintenance.

Form, fill and seal type bagging machines are available which perform high-speed bagging of various products. For producers with small volumes, or those requiring large variety of packaging and bags, this equipment is unsuitable due to its high cost and specialized skills in reconfiguration for different packaging needs. The use of these machines is further complicated by the need for specialized graphics and product marking. Wicket type bagging machines are also available and have advantages in flexibility over more complicated form, fill and seal machines, but for the most part are slow and labor intensive for most bagging evolutions.

There exists a need for bagging machines that utilize pre-made bags which provide high-speed operation and can be quickly changed for different products and packaging requirements.

OBJECTS AND SUMMARY OF THE INVENTION

Therefore, an object of the present invention is to provide a bagging apparatus which provides a bagging station for use with pre-made wicket bags, and provides for high speed automated loading, filling and sealing of bags with a variety of products.

Another object of the present invention is to provide a bagging apparatus which incorporates multiple bagging stations so that bags can be loaded on the apparatus during bagging operations;

Another object of the present invention is to provide a bagging apparatus which incorporates multiple bagging stations so that different type and sized bags can be loaded on the apparatus at the same time;

Another object of the present invention is to provide a bagging apparatus with an indexing means to index wicketed bags to the desired position each time a bag is removed from the wicket;

Another object of the present invention is to provide a bagging apparatus with a short, single vertical transfer of the bag after filling, to allow quick cycle time; and Still another object of the present invention is to provide a vertical bagging apparatus with a positive means for bag chip removal after sealing.

The bagging apparatus of the present invention comprises a carousel-type bagging assembly having four separate bagging stations. Each station utilizes a wicket bar and a wicket wire or other retaining means to support a wicket of open-top bags on the wicket bar. Each wicket station is engageable with a wicket advance cylinder when in the position adjacent to the product tooling.

A product tooling assembly comprises a tool horn for receipt of the product to be bagged and for dispensing the product in an opened bag. A bag transfer assembly comprises a pair of vertically and horizontally translatable grippers for gripping the bag before, during, or immediately following the filling operation, and lowering the filled bag to a seal assembly. The seal assembly seals the bag, cuts a top "chip" from the bag, and provides a means for discharging the "chip" to a disposal system. The grippers of the bag transfer assembly may be used to positively remove the "chip" from the sealed bag.

A programmable logic controller (PLC) provides a control means for the actuators of the apparatus, and allows flexibility for quick changes in types of products, bags, and sequence of operations.

The direct, single vertical motion from the product tooling to the seal assembly allows high speed cycling of the apparatus. Re-positioning of the tooling assembly and grippers can be accomplished coincident to bag sealing operations to reduce cycle time. The wicket advance cylinder allows indexing of the active bag station each cycle by biasing the active wicket against a reference point on the frame of the apparatus.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a vertical bagging apparatus for high speed bagging operations.

Figure 1B:
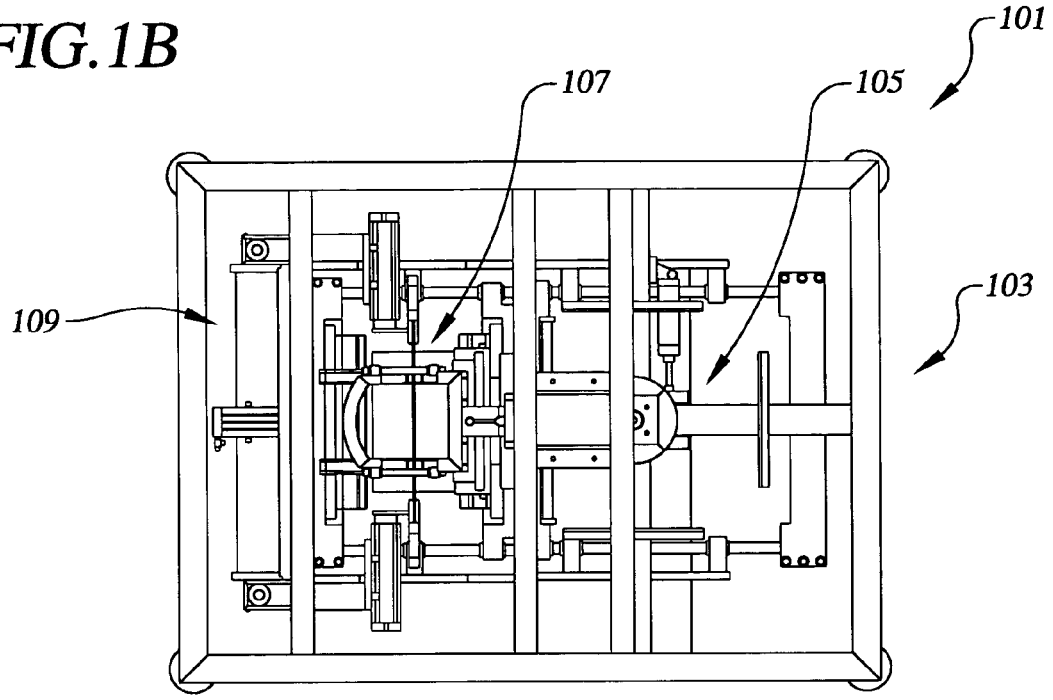
FIG. 1B is a top view of the assemblies shown in FIG. 1A of the vertical bagging apparatus.
Figure 1A:
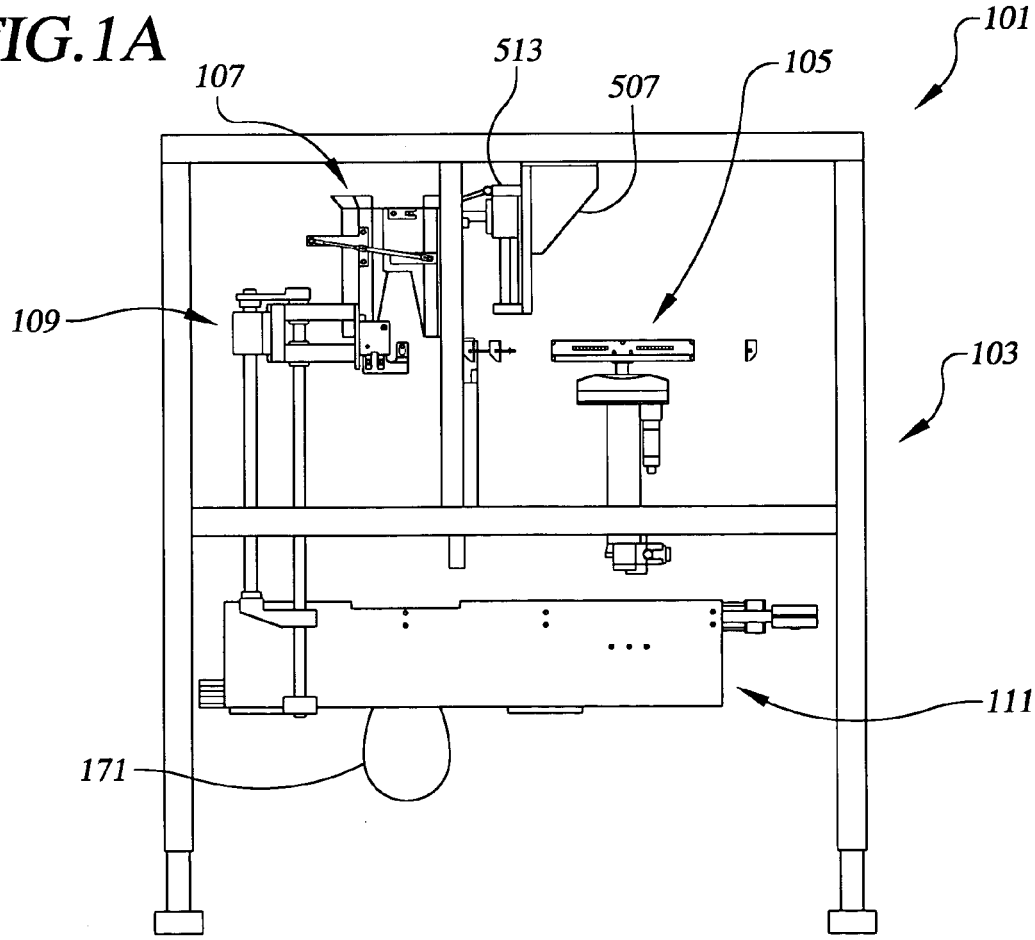
FIG. 1A is a side elevation drawing of the frame and some of the major assemblies of the bagging apparatus showing the bag carousel and position of the wicket bars of the bagging station, the product tooling assembly and slide cylinder, the bag transfer assembly, and a filled bag in the bag seal assembly.
Figure 2:
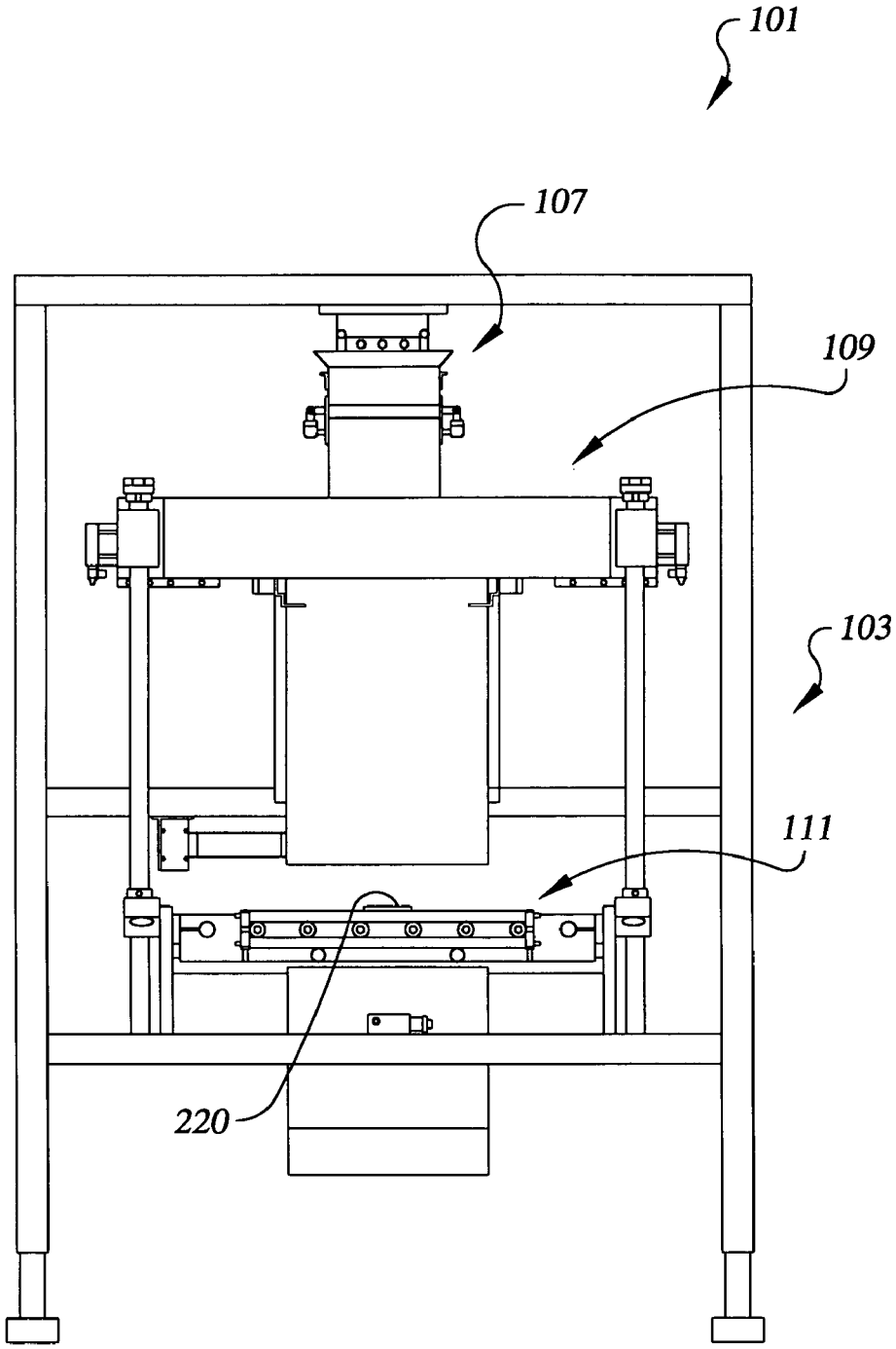
FIG. 2 is a front view of the major assemblies of the apparatus.
Figure 3:
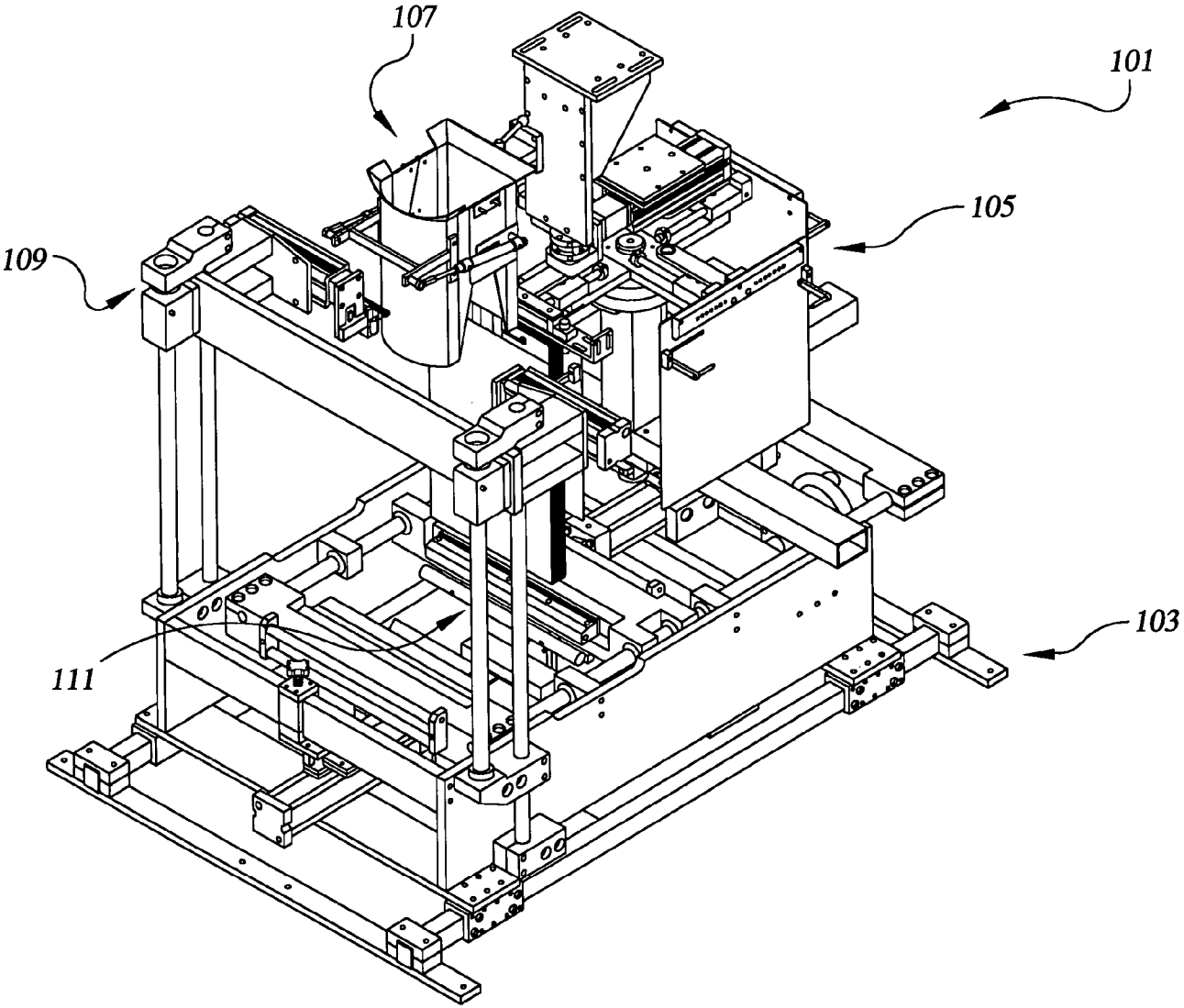
FIG. 3 is a perspective drawing of the major assemblies of the vertical bagging apparatus with some of the framing removed for clarity.

FIG. 1A is a side elevation drawing, FIG. 1B is a top view, and FIG. 2 is a front elevation drawing of the major assemblies of the bagging apparatus 101. FIG. 3 is a perspective view of the vertical bagging apparatus with some structural framing removed for clarity.

Referring to FIGS. 1–3, framing 103 supports the major assemblies of the bagging apparatus including a 4-wicket, carousel type bag station 105, product tooling assembly 107, bag transfer assembly 109, and bag seal assembly 111. Bag seal assembly 111 is located vertically below tooling assembly 107, allowing a direct, single-motion transfer of bags by bag transfer assembly 109.

Figure 4:
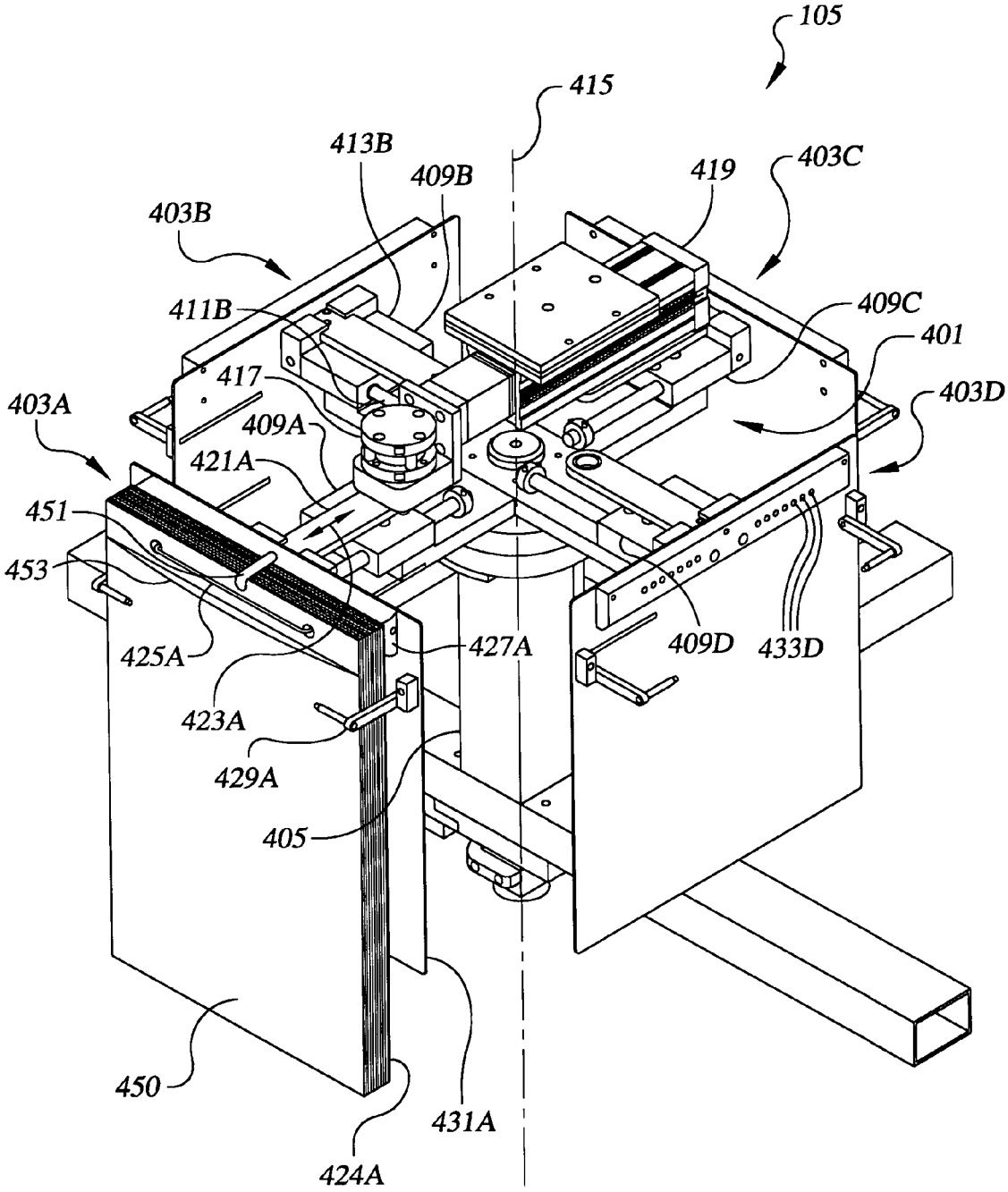
FIG. 4 is a detailed perspective drawing of the bag station of the apparatus showing a wicket of bags in the loading station.

FIG. 4 is a detail perspective drawing of the bag station 105 showing carousel assembly 401 supporting four wicket stations 403A, 403B, 403C, and 403D. Carousel assembly 401 comprises a stationary vertical support post 405 and a rotating shaft 407 connected to wicket sliding support assemblies 409A, 409B, 409C and 409D. The support assemblies comprise a sliding block and support rods such as sliding block 413B and support rod 411B for assembly 403B, allowing wicket stations 403A–403D to slide radially in and out relative to vertical axis 415. A pneumatic cylinder and ratchet assembly (not shown) rotates shaft 407 and wicket stations 403A–403D about axis 415 upon command from programmable logic controller (PLC) 901 of FIG. 9.

Upon rotation of shaft 407 to position a wicket to the position of wicket station 403A, PLC 901 energizes solenoid 417 that engages wicket advance cylinder 419 to the corresponding wicket bar bracket 421A. Engagement of wicket bar bracket 421A to cylinder 419 allows PLC 901 to advance or retract wicket station 403A in the direction of arrow 423A. Wicket station 403A comprises a wicket wire 425A that retains a stack 424A of wicket bags on wicket bar 427A. Spring-loaded retainer pins 429A retain wicket stack 424A against back plate 431A. A spring-loaded slide (not shown) on wicket bar 427A engages wicket wire 425A inserted in wicket bar holes (similar to holes 433D of wicket station 403D) in wicket bar 427A. The construction and operation of the other wicket stations is similar, except that solenoid 417 engages only the wicket bar bracket of the wicket station in the position of wicket station 403A.

Air jet 451 provides a means to open the top opening 453 of front bag 450 of wicket 424A. Air jet 451 may be a single jet controlled by a solenoid valve connected to PLC 901 or it may be an air knife or other bag opening means known in the art.

Figure 5:
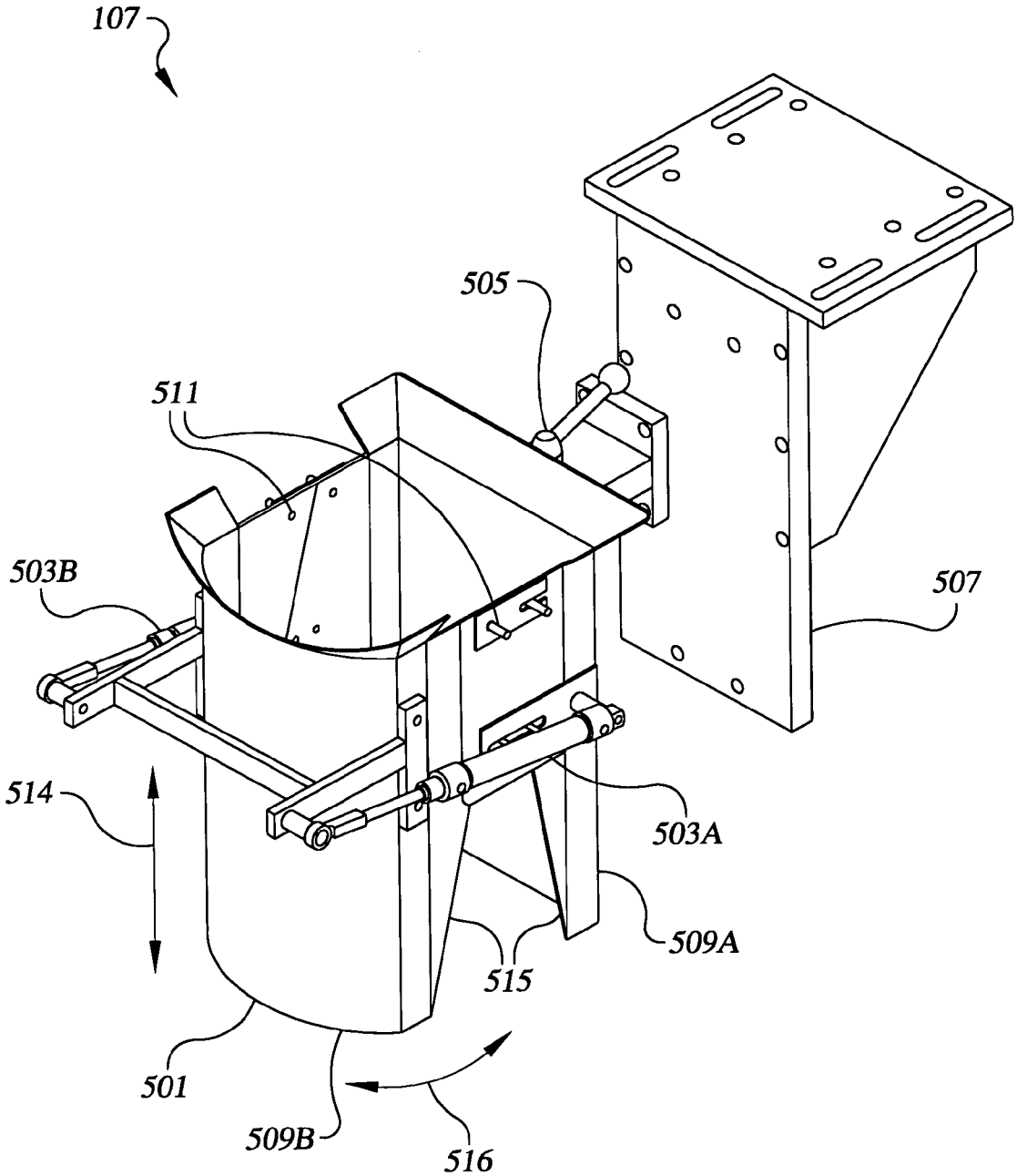
FIG. 5 is a detail perspective drawing of the product tooling assembly of the apparatus showing the pivoting tooling portions, and quick-change fastener for tooling changes.

FIG. 5 is a detail perspective view of tooling assembly 107 comprising tooling horn 501, tooling cylinders 503A and 503B, and quick change fastener 505 attaching tooling horn 501 to bracket 507 via a slide cylinder 513, best shown on FIG. 1A. Slide cylinder 513 allows tooling assembly 107 to be raised or lowered in direction 514 to engage a bag such as bag 450 of FIG. 4. Horn portions 509A and 509B are connected by pivots 511 to allow horn portion 509B to pivot inward and outward in directions 516 upon actuation of tooling cylinders 503A and 503B. Cutout portion 515 on horn portions 509A and 509B allows closing of the bottom of tooling horn 501 to prevent discharge of product from horn 501 until actuation of tooling cylinders 503A and 503B.

Figure 6:
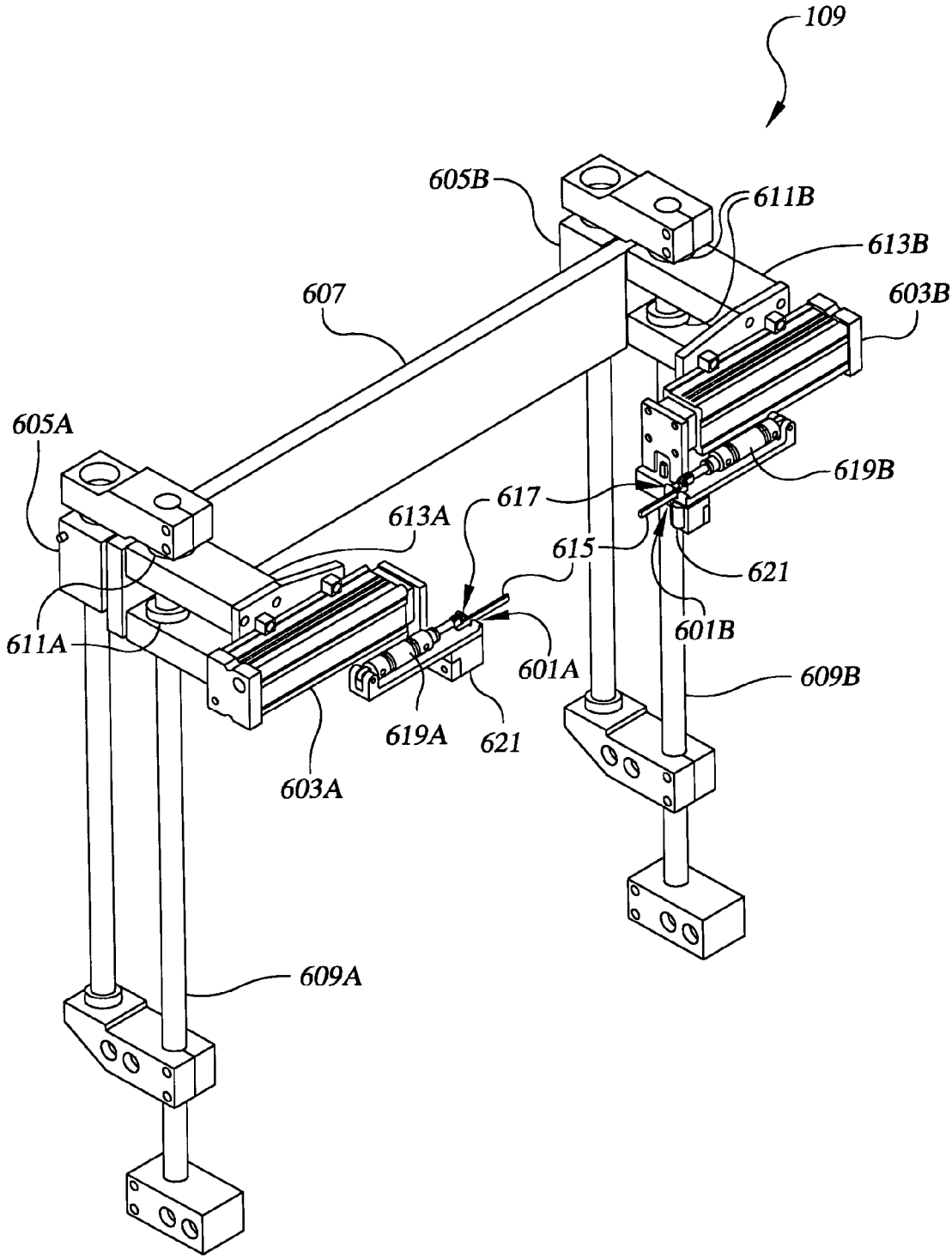
FIG. 6 is a detail perspective drawing of the bag transfer assembly showing the grippers in an unengaged position.

FIG. 6 is a detail perspective drawing of bag transfer assembly 109 showing bag grippers 601A and 601B mounted on transverse positioning cylinders 603A and 603B. Vertical positioning cylinders 605A and 605B are rodless cylinders which position bracket assembly 607 supporting transverse positioning cylinders 603A and 603B vertically along vertical guide rods 609A and 609B. Bushings 611A and 611B provide bearing surfaces for bracket portions 613A and 613B of bracket assembly 607. Grippers 601A, 601B comprise grip bars 615 which pivot about gripper pivots 617 when upon actuation by gripper cylinders 619A, 619B. Upon downward rotation about pivots 617, gripper bars 615 clamp bag edges against gripper faces 621.

Figure 7:
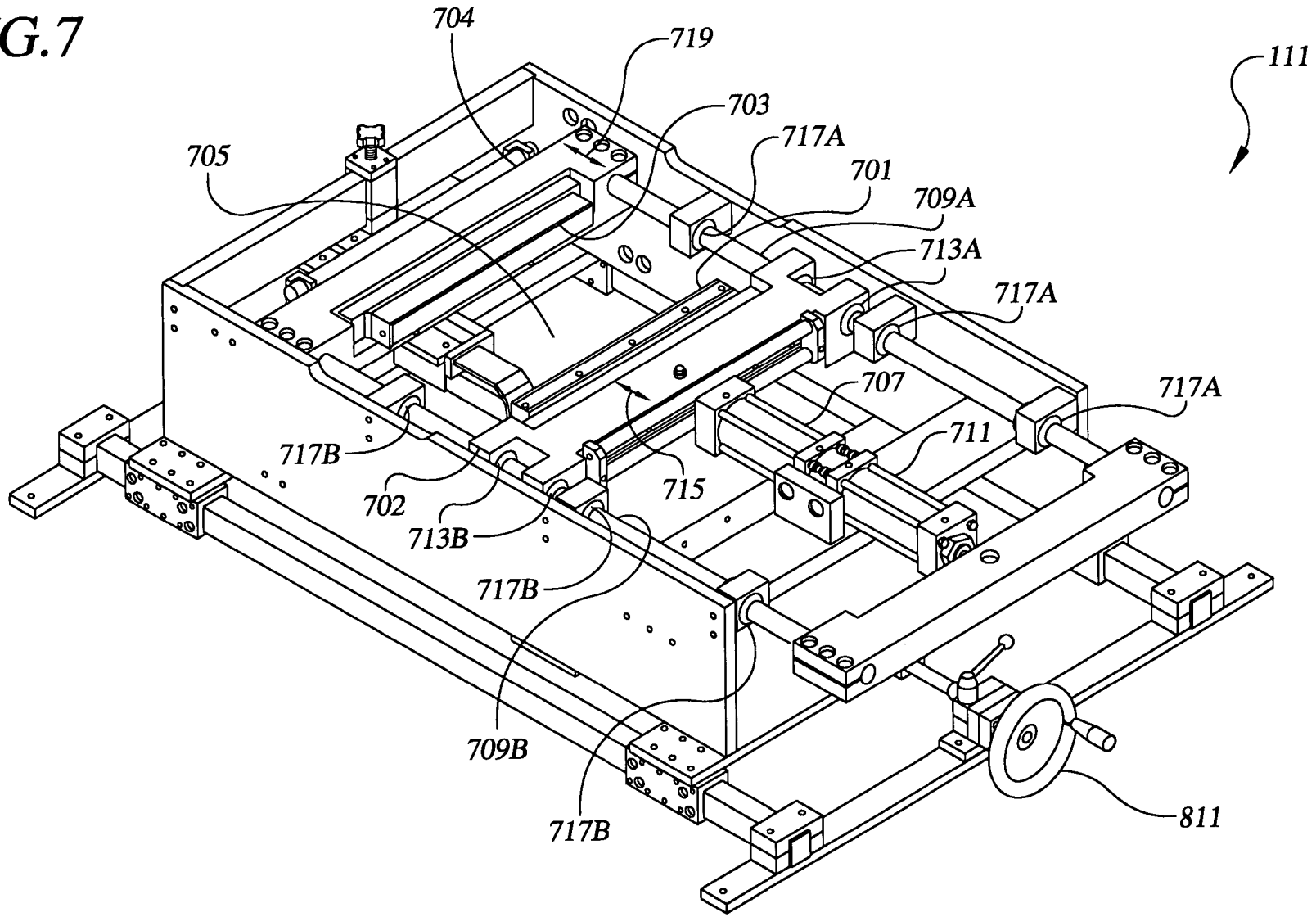
FIG. 7 is a detail perspective drawing of the bag seal assembly showing the seal bars, deflation plates, and actuators.

FIG. 7 is a perspective drawing of the bag seal assembly 111, which in the preferred embodiments, is positioned vertically below tooling assembly 107 of FIGS. 1A, 1B, 1C. Seal assembly 111 comprises heated seal bar 701 and complementary seal bar 703 for sealing and trimming the top of a filled bag such as bag 171 of FIG. 1A. Transfer assembly 109 lowers bag 171 vertically through opening 705 of bag seal assembly 111 so that the seal area of bag 171 is positioned in the path of seal bars 701 and 703 and bag 171 is in the position shown in FIG. 1A. Pneumatic cylinder 707 positions seal bar 701 and holder 702 along rods 709A, 709B, and cylinder 711 positions seal bar 703 and holder 704 by extending or withdrawing rods 709A, 709B. Bushings 713A and 713B allow transverse motion of holder 702 along direction 715 and bushings 717A and 717B allow transverse motion of rods 709A, 709B, and holder 704 along direction 719.

Figure 8:
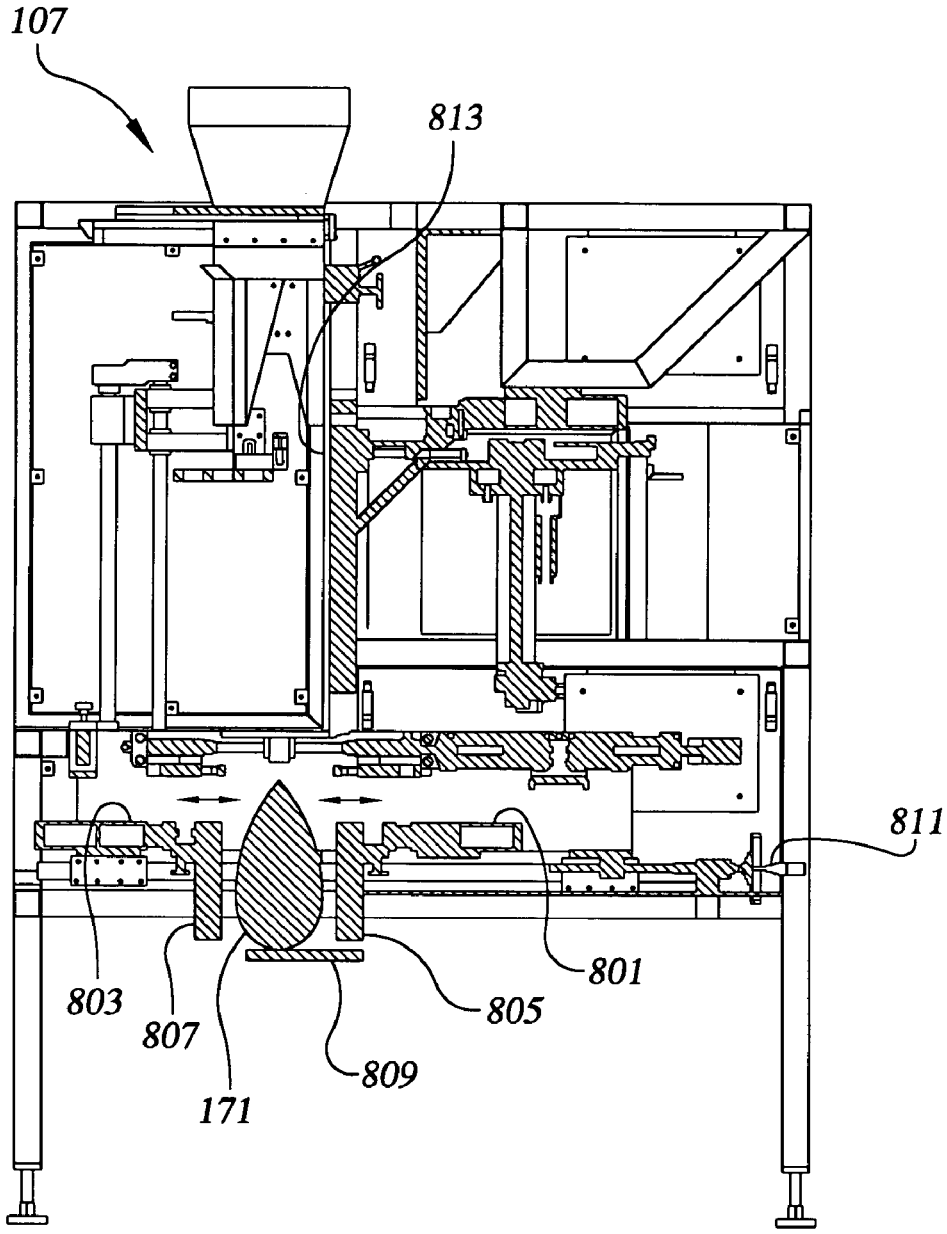
FIG. 8 is a side cross section of the vertical bagging apparatus showing the major assemblies of the apparatus and a filled bag in the seal assembly.

Pneumatic cylinders 801 and 803 of FIG. 8 position deflation plates 805 and 807 respectively to remove air from bag 171 prior to sealing. Plates 805 and 807 are displaced transversely in along directions indicated to press and deflate bag 171, and to retract to allow discharge of filled and sealed bag 171. Retractable support plate 809 provides support for bag 171 upon sealing and cutting of the bag "chip" produced when seal bars 701 and 703 of FIG. 7 seal and cut the bag top. Plate 809 may be retracted by a retraction cylinder (not shown) to discharge bag 171 to a conveyor or other storage or transfer apparatus for processing. Handwheel 811 provides a means to adjust the position of seal assembly 111 to accommodate different size bags and product.

Figure 9:
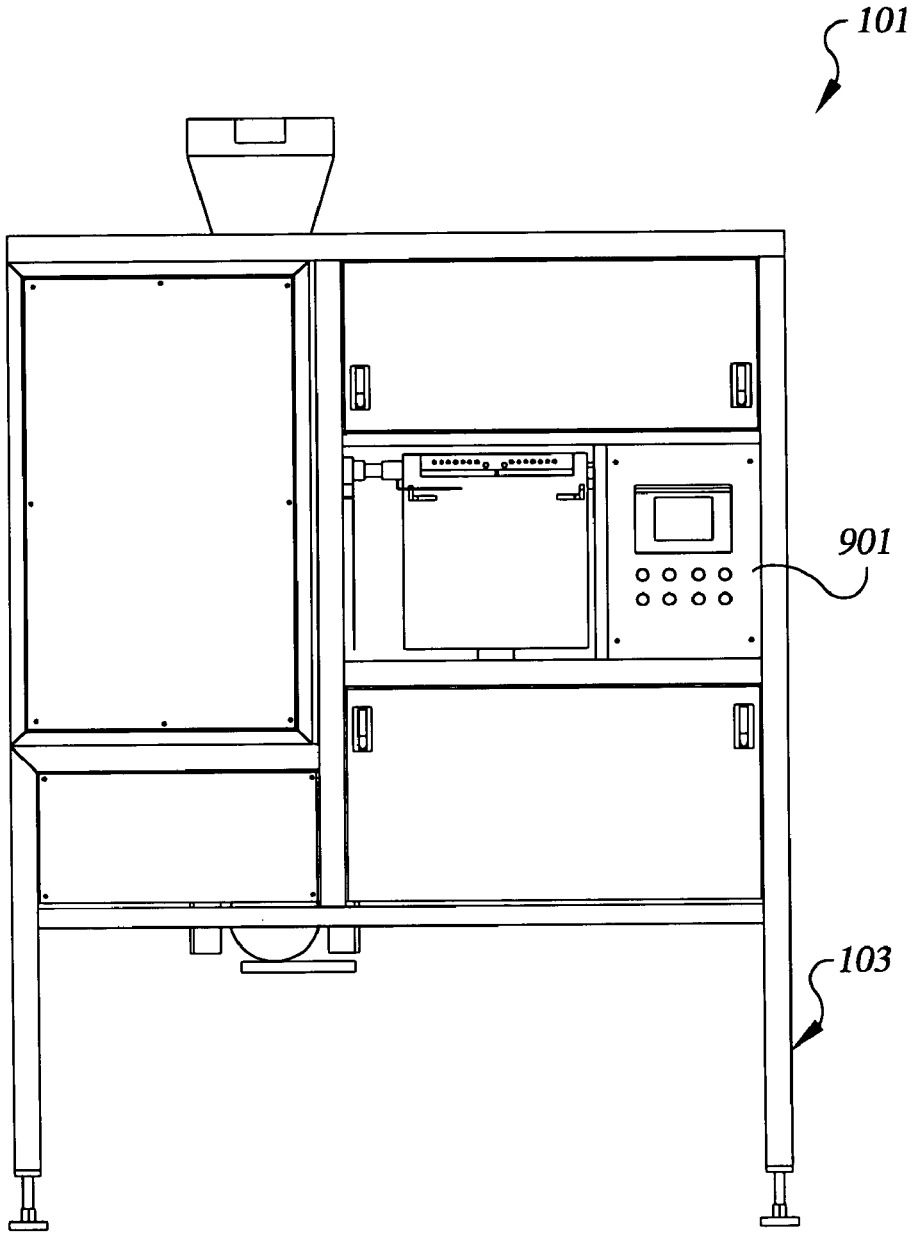
FIG. 9 is a side elevation drawing of the vertical bagging apparatus showing the framing, outside covers, and programmable logic controller of the device.

FIG. 9 is an elevation drawing of the outside components of the apparatus 101 showing programmable logic controller (PLC) 901 for providing logic actuation signals to the actuators of the apparatus.

Figure 10:
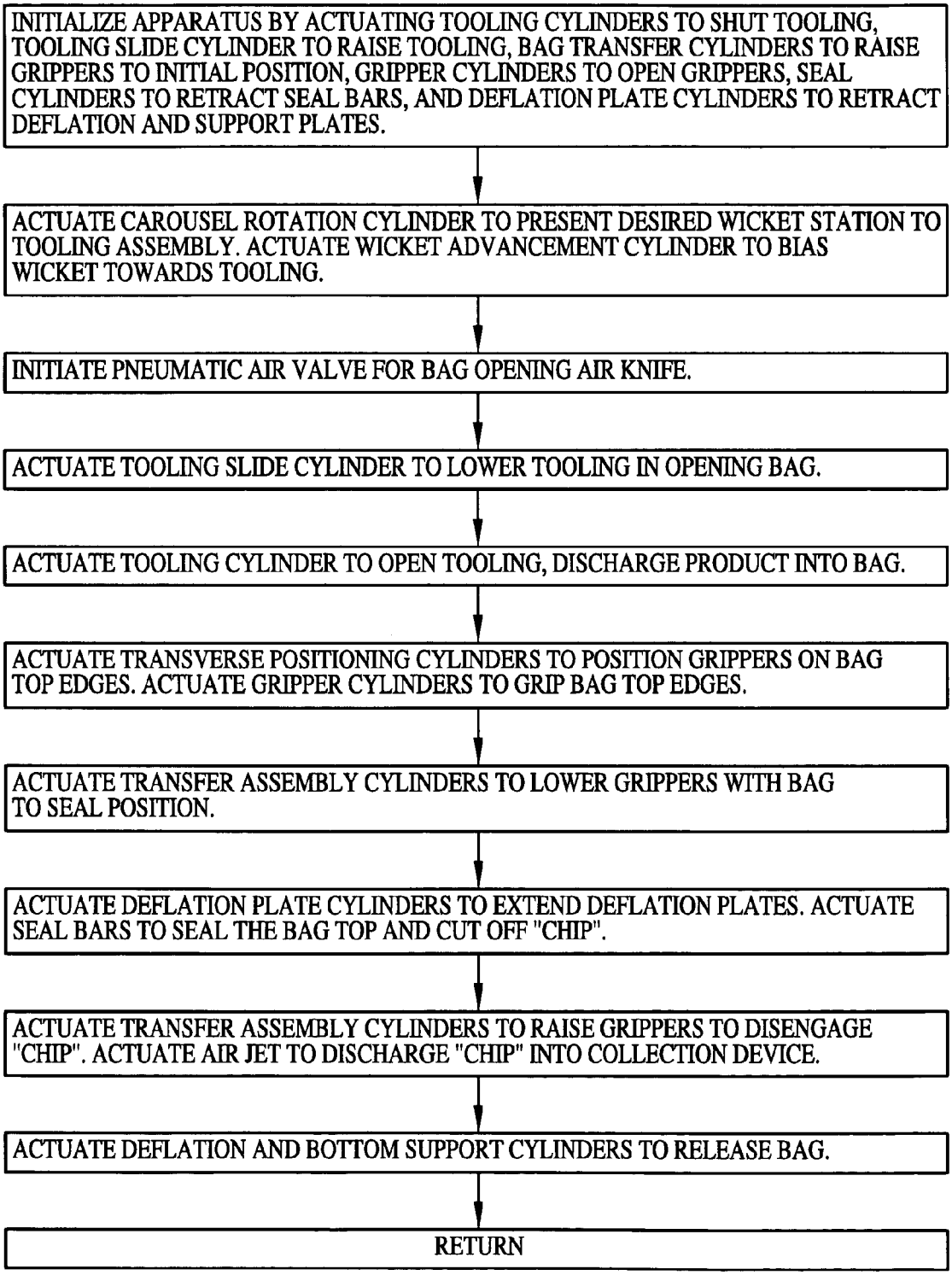
FIG. 10 is a logic diagram of a sequence of operations for the vertical bagging apparatus.

FIG. 10 is a logic diagram of PLC 901 logic in one preferred embodiment of the present invention. The bagging apparatus allows installation of up to four wickets of bags on the bagging station. Either similar or different bags may be installed on the carousel simultaneously. Empty bag stations on the carousel may be loaded during bagging operations, reducing downtime for loading. The PLC of the apparatus allows programming to account for differences in bag sizes and capacities.

Once the bag station 105 has been loaded PLC 901 initializes the apparatus by actuating the tooling cylinders 503A, 503B to close the product tooling to allow loading of the tooling and allow insertion of a bag during the following operations. The tooling slide cylinder 513 is actuated to raise the tooling to the loading position. The bag transfer cylinders 605A, 605B are actuated to raise the bag grippers 601A, 601B to the initial loading position, and the gripper cylinders 619A, 619B are actuated to open the grippers in the position shown in FIG. 6. Seal cylinders 707, 711 actuate to retract seal bars 701 and 703, and deflection plate cylinders 801, 803 actuate to retract deflation plates 805 and 807.

To initiate a bagging operation, PLC 901 actuates the carousel rotation cylinder to rotate the desired wicket station to the bagging position of 403A of FIG. 3. Solenoid 417 is actuated to engage wicket bar 427A of wicket station 403A to wicket advance cylinder 419. Cylinder 419 is actuated to bias wicket wire 425A against a frame stop 813 of FIG. 8. An air solenoid (not shown) is actuated by the PLC to pressurize air jet 451 to engage and open top edge 453 of bag 450. An air knife along the top edge of wicket bar 427A (not shown) may also be used to aid in opening bag 450. PLC 901 activates slide cylinder 513 of FIG. 1A to lower tooling horn 501 into opened bag 450.

PLC 901 actuates traverse positioning cylinders 603A, 603B to position grippers 601A, 601B adjacent to opened bag edges and gripper cylinders 619A, 619B to grip the bag edges. Unless performed previously, PLC initiates product dispensing (not shown) into product tooling horn 501, and actuates tooling cylinders 503A, 503B to open horn portion 509B to dispense product in bag 450. Transfer assembly cylinders 605A, 605B are actuated to lower bag 450 to the sealing position of FIG. 8 (filled bag shown as 171 in the figures). During the downward vertical transfer, PLC 901 actuates traverse positioning cylinders 603A, 603B to extend bag 450 top edges away from each other to close the bag top portion.

Upon bag 171 reaching the position of FIG. 8, PLC 901 actuates deflation plate cylinders 801 and 803 to a predetermined position to deflate and remove air from bag 171. PLC 901 then activates seal cylinders 707 and 711 to engage heated seal bar 701 and seal bar 703 at the top portion of bag 171 to seal the bag and cut the top "chip" from the bag. PLC 901 activates transfer assembly cylinders 605A, 605B to raise closed grippers 601A, 601B and positively separate and remove the "chip" from bag 171. Once the "chip" has been separated, PLC 901 initiates a chip disposal jet (220 of FIG. 2) disposed on the bag seal assembly and discharges the chip into a disposal unit such as vacuum disposal unit.

Upon completion of the seal operation and chip removal, PLC 901 actuates a support plate 809 actuator to allow filled bag 171 to drop to a bagged product conveyance means such as a bagged product conveyor (not shown).

To complete the cycle, PLC 901 initializes the apparatus for another bagging operation as described above. The bias provided by wicket advance cylinder 419 allows indexing of wicket wire 425A and wicket bags 424A by the distance of one bag thickness each cycle of the apparatus.

Figure 11:
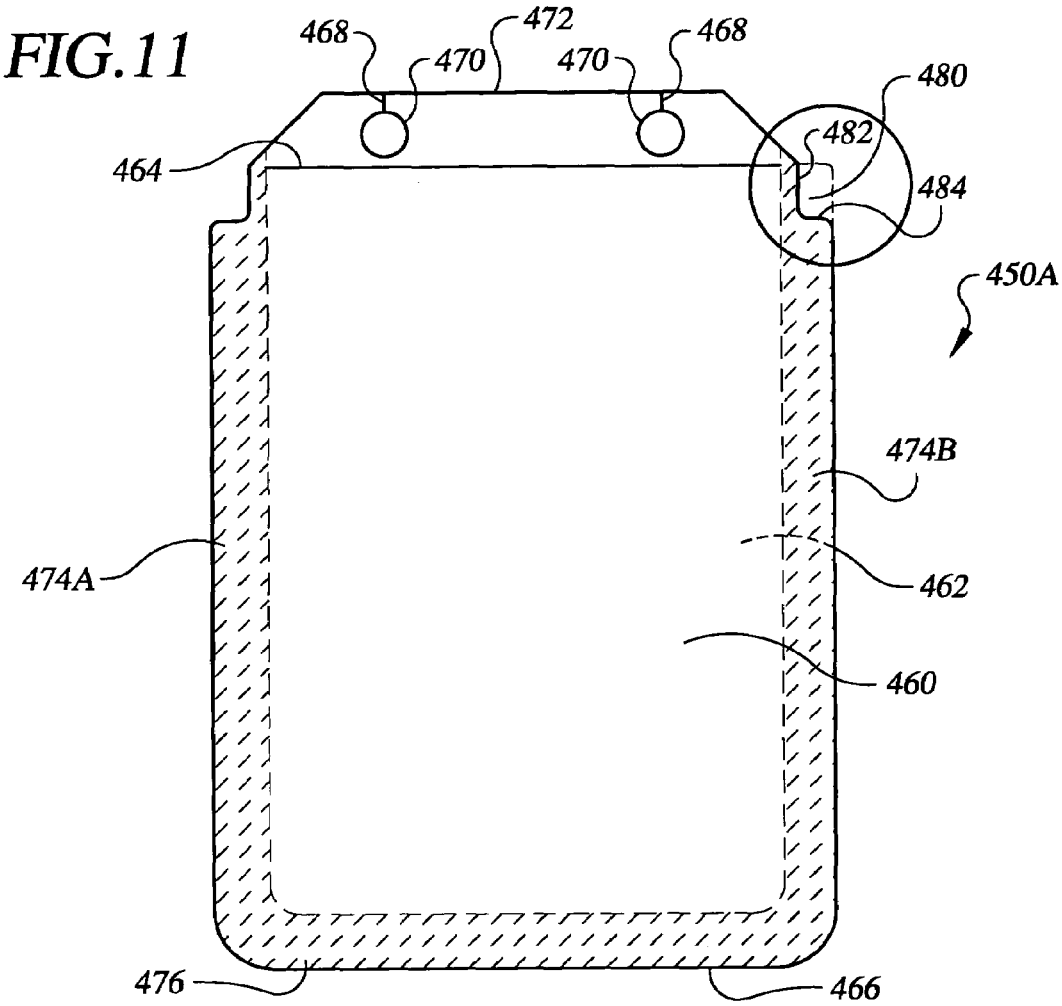
FIG. 11 is a front elevation drawing of a wicketed bag having a notched upper side seal for reducing wrinkling during sealing.

FIG. 11 is a front elevation drawing of an embodiment of a wicket bag 450A for use with the apparatus of FIGS. 1–9. Bag 450A comprises a front side 460, back side 462, open top 464, and closed bottom 466. Wicket holes 470 provide a means for support from wicket wire 423A of FIG. 4 and slits 468 provide a means for removing bag 450 from wicket wire 423A. Wicket tab portion 472 extends from bag back 462 and is part of the "chip" portion removed during sealing and cutting as described earlier.

In the preferred embodiments, bag 450A is a side sealed bag having side seals 474A and 474B to seal the bag sides. Closed bottom 466 may be a fold or gusset type bottom as known in the art, or it may incorporate a separate bottom seal 476.

In the preferred embodiments, the upper portion of the side seals 474A, 474B comprise a seal notch portion 480 having a vertical cut 482 and a horizontal cut 484. The right side notch portion is shown in FIG. 11, the left side comprises a similar notch portion. In the preferred embodiments, notch portion 480 is formed by die cutting and removal of a cutout portion defined by vertical cut 482, horizontal cut 484, and the broken lines of the figure. Bag 450A may be formed in a conventional manner with the notch die cuts made subsequent to side seal forming. In other embodiments, notch portion 480 is cut before side seals 474A, 474B are formed. The reduced width of the upper side seal portion as compared with the rest or lower side seal portion reduces wrinkling and deformation of the top seal formed during the sealing operation.

Figure 11A:
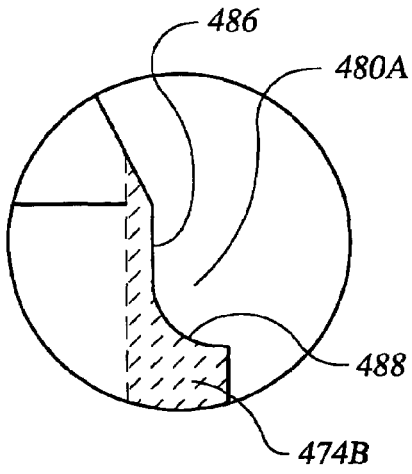
FIG. 11A is an alternative embodiment of the bag of FIG. 11 having a partially concave notched portion.
Figure 11B:
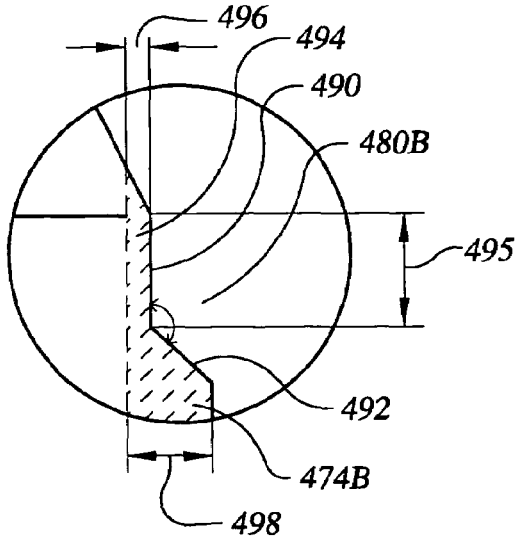
FIG. 11B is an alternative embodiment of the bag of FIG. 11 having an angled notch cut.

FIG. 11A shows an alternative embodiment of notch portion 480A having a vertical cut 486 and concave portion 488. FIG. 11B shows an embodiment with a notch portion 480B having a vertical cut 490 and an angle cut 492 forming an obtuse angle with vertical cut 490. The notch portions define an upper seal portion 494 of reduced width 496 as compared with the width 498 of the lower portion of side seal 474B. In the preferred embodiments, width 496 is less than ¼", in the more preferred embodiments, width 496 is less than 3⁄16", and in the most preferred embodiments, width 496 is less than ⅛". In the preferred embodiments, notch length 495 is less than the length of bag 450A, and in the more preferred embodiments, length 496 is less than 2", and in the most preferred embodiments, length 496 is less than 1".

Figure 12:
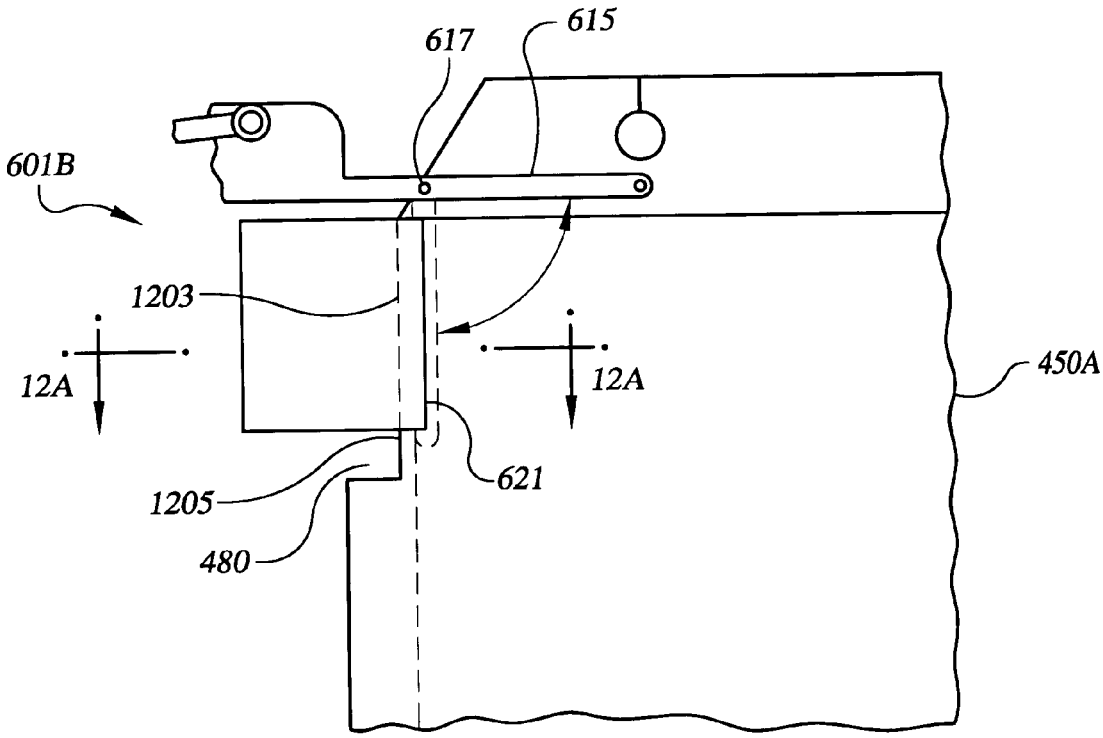
FIG. 12 is a detailed elevation drawing of an embodiment of one of the bag grippers of the bagging apparatus showing a groove in the gripper block for nesting the upper side seal area of a wicketed bag.
Figure 12A:
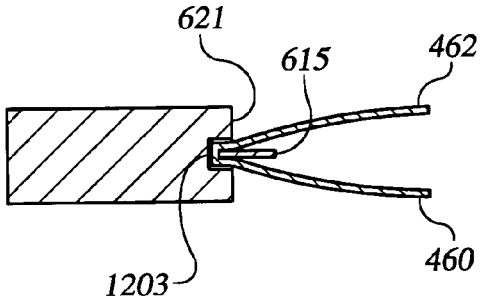
FIG. 12A is a cross sectional drawing of the gripper block, gripper bar and bag of FIG. 12 taken through lines 12A—12A of FIG. 12.
Figure 12B:
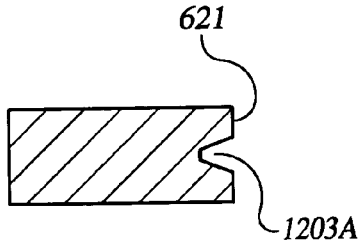
FIG. 12B is a cross-sectional drawing of and alternative embodiment of the gripper block, gripper bar and bag of FIG. 12.

FIG. 12 is a detail elevation drawing of the engagement of notched bag 450A in the gripper 601B of FIG. 6. Groove 1203 of gripper face block 621 provides a recess for upper seal portion of bag 450A to seat in during gripping of bag 450A (shown in phantom lines) and sealing of the top of bag 450A during the sealing operation. FIG. 12A is a cross section of bag 450A and face 621 taken along lines 12A—12A of FIG. 12. The recess formed by rectangular groove 1203 reduces deformation of the upper seal portion during gripping of bag 450A and reduces distortion and wrinkling of the top seal formed during the sealing operation. FIG. 12B shows an alternative embodiment of face 621 having a groove 1203A of trapezoidal section. The converging portion of groove 1203A toward the center of the block provides guiding of the bag side edge 1205 into groove 1203A as gripper bar 615 grips the inside of bag 450A. Other groove cross-sectional shapes may be used such as semi-circular, and elliptical shapes.

In the preferred embodiments, the width of groove 1203 is selected to provide a close clearance with the thickness of the upper seal portion of bag 450 as shown in FIG. 12A. The depth of groove 1203 is selected to be approximately the width of the upper seal portion. Groove 1203 provides improved gripping and reduced seal distortion on notched bags such as bag 450A, and on conventional, non-notched bags. In still other embodiments, the width of gripper bar 615 may be made wider than the opening of groove 1203 or 1203A to provide a seating surface to further reduce crushing of the side seal portion inside the groove.

Figure 13:
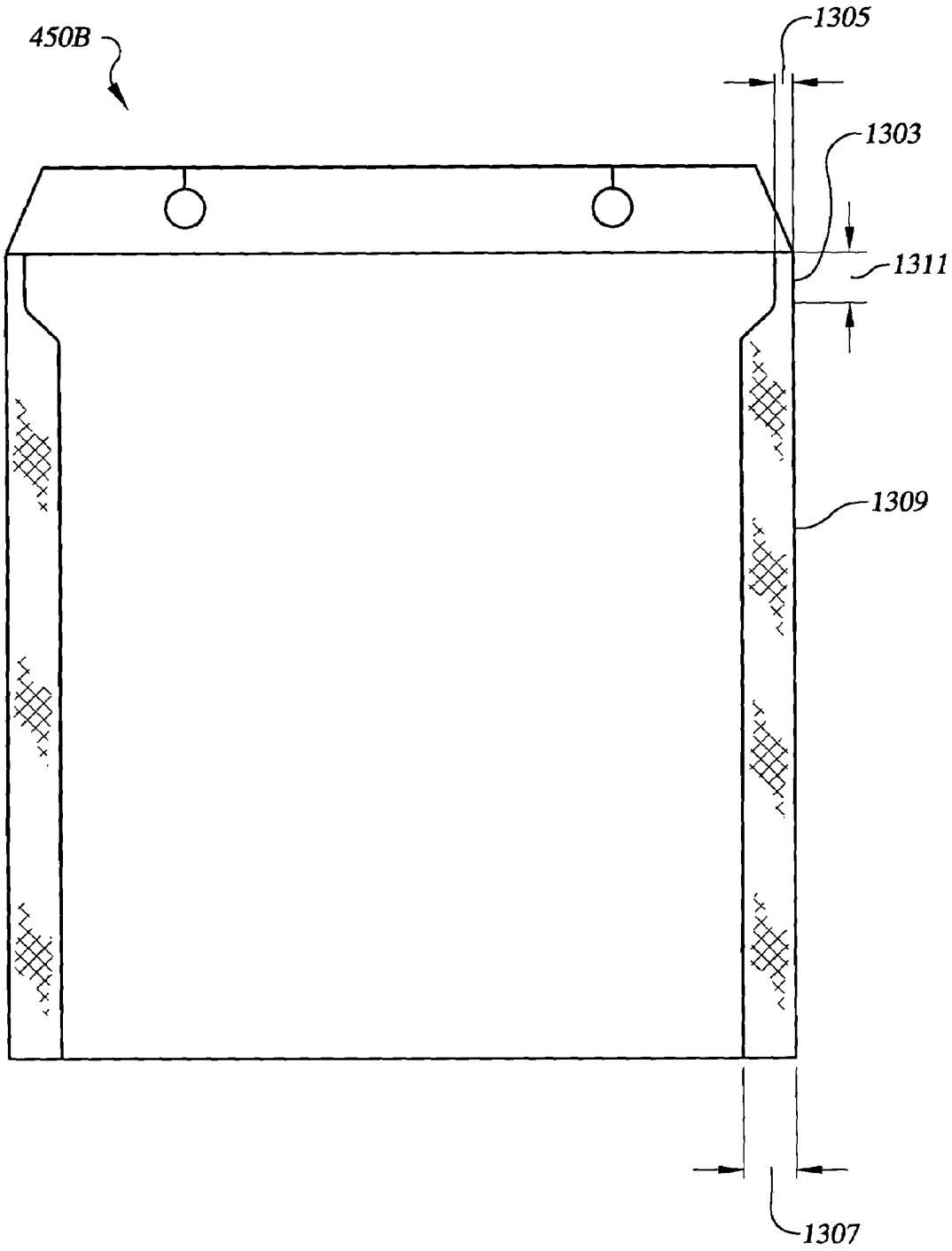
FIG. 13 is an alternative embodiment of a notch-less wicketed bag having straight side-sealed edges and a reduced-width upper side seal portion.

FIG. 13 a front elevation drawing of embodiment 450B of a wicket bag for use with the apparatus of FIGS. 1–9. Upper side seal portion 1303 has a reduced width 1305 as compared to the width 1307 lower side seal portion 1309. The reduced width of upper side seal portion 1303 reduces distortion of the upper portion of the bag during gripping and reduces wrinkling and deformation of the top seal during the sealing operation. The length 1311 of the upper side seal portion is similar to length 495 of FIG. 11B. The grooved block face 621 of FIG. 12 may be used with this bag, or the bag may be used with conventional wicket bagging apparatus.

In other embodiments of the invention, the bag transfer assembly may be angled, preferably with a direct motion to minimize transfer time. Linear positioners or other actuation devices may be used to provide the actions performed by the pneumatic cylinders of the apparatus. Variations of tooling and product conveyance means may be incorporated to optimize bagging of different products utilizing different bags. Various types of controllers such as micro controllers or relay boxes may be substituted for a PLC.

Accordingly, the reader will see that vertical bagging apparatus provides a high speed bagging machine for wicketed bags. The device provides the following additional advantages:

The bag transfer is a single, direct motion, increasing reliability and speed;

The carousel-type bag station allows loading of bags during bagging operations, as well as different types of bags for quick product changes;

The wicket advance cylinder allows indexing of the wicket station at each bagging cycle; and The apparatus is simple and inexpensive.

Although the description above contains many specifications, these should not be construed as limiting the scope of the invention but merely providing illustrations of some of the presently preferred embodiments of this invention. Thus the scope of the invention should be determined by the appended claims and their legal equivalents, rather than by the examples given.

I claim:

1. A bagging apparatus for bagging articles in bags supported from a wicket, the apparatus comprising:

a frame:

a bag station attached to the frame, the bag station comprising a plurality of wicket support bars;

a tooling assembly disposed vertically above and adjacent to at least one of said plurality of wicket bars;

a bag transfer assembly attached to the frame and comprising a bag engagement element for gripping a bag dispensed from said at least one of said plurality of wicket bars and transferring said bag to a seal assembly disposed vertically below the tooling assembly; and;

a bias element cooperating with each of the plurality of wicket support bars for indexing a wicket wire of a bag wicket attached to said at least one of said plurality of wicket bars toward a frame stop attached to said frame.

2. The apparatus of claim 1 wherein said bias element indexes said at least one of said plurality of wicket bars toward said frame stop upon each bagging cycle.

3. The apparatus of claim 2 wherein said bias element indexes said at least one of said plurality of wicket bars a distance related to the thickness of said bag toward said frame stop upon each bagging cycle.

4. The apparatus of claim 1 wherein said bag station comprises four wicket bars.

5. The apparatus of claim 4 wherein said four wicket bars are disposed on a rotatable carousel attached to the frame.

6. The apparatus of claim 1 wherein said plurality of wicket bars are disposed on a rotatable carousel attached to the frame.

7. The apparatus of claim 1 wherein said transfer assembly comprises a gripper element disposed on either side of said tooling assembly.

8. The apparatus of claim 7 comprising a linear actuator attached to said gripper element disposed on either side of said tooling assembly.

9. The apparatus of claim 8 wherein said linear actuator attached to said gripper element disposed on either side of said tooling assembly is attached to a cross beam vertically translatable about a vertical guide attached to the frame.

10. The apparatus of claim 1 wherein said bias element is a single pneumatic cylinder attached to the frame.

* * * * *